US011271294B2

(12) United States Patent
Ishida et al.

(10) Patent No.: US 11,271,294 B2
(45) Date of Patent: Mar. 8, 2022

(54) VEHICLE ANTENNA DEVICE

(71) Applicant: HARADA INDUSTRY CO., LTD., Tokyo (JP)

(72) Inventors: Jun Ishida, Tokyo (JP); Tomochika Yoshiga, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 18 days.

(21) Appl. No.: 16/981,144

(22) PCT Filed: Mar. 6, 2019

(86) PCT No.: PCT/JP2019/008871
§ 371 (c)(1),
(2) Date: Sep. 15, 2020

(87) PCT Pub. No.: WO2019/188072
PCT Pub. Date: Oct. 3, 2019

(65) Prior Publication Data

US 2021/0119328 A1 Apr. 22, 2021

(30) Foreign Application Priority Data

Mar. 30, 2018 (JP) ..... JP2018-069321

(51) Int. Cl.
*H01Q 1/32* (2006.01)
*H01Q 9/40* (2006.01)
*H01Q 5/314* (2015.01)

(52) U.S. Cl.
CPC ..... *H01Q 1/3291* (2013.01); *H01Q 9/40* (2013.01); *H01Q 5/314* (2015.01)

(58) Field of Classification Search
CPC ..... H01Q 1/3291; H01Q 9/40; H01Q 5/314; H01Q 1/38; H01Q 1/36; H01Q 1/48; H01Q 21/28
See application file for complete search history.

(56) References Cited

U.S. PATENT DOCUMENTS

2015/0357705 A1 12/2015 Ito
2016/0079661 A1 3/2016 Ito et al.
(Continued)

FOREIGN PATENT DOCUMENTS

JP 3129472 U 2/2007
JP 2014216661 A 11/2014
(Continued)

OTHER PUBLICATIONS

International Search Report in PCT/JP2019/008871 dated May 28, 2019.

*Primary Examiner* — David E Lotter
(74) *Attorney, Agent, or Firm* — Global IP Counselors, LLP

(57) ABSTRACT

A vehicle antenna device includes an antenna element, a circuit board, a coil, an amplifier circuit and a fixing portion. The antenna element functions as a capacitive antenna supporting a first frequency band. The circuit board has a power feeding portion that is connected to a power feeding line of the antenna element. The coil is electrically connected to the power feeding portion so that the antenna element has an antenna length supporting a second frequency band. The fixing portion and the antenna element are formed at an edge of the antenna element in order to fix the circuit board to the antenna element at a location close to the position of the coil and far from a position of the amplifier circuit. The fixing portion is provided with a predetermined gap from the coil that is large enough to avoid the influence of coupling with the coil.

11 Claims, 3 Drawing Sheets

(56) References Cited

U.S. PATENT DOCUMENTS

| | | | | |
|---|---|---|---|---|
| 2018/0261913 | A1* | 9/2018 | Imamura | H01Q 1/3275 |
| 2020/0099137 | A1* | 3/2020 | Miura | H01Q 1/3275 |

FOREIGN PATENT DOCUMENTS

| | | | |
|---|---|---|---|
| JP | 2016012915 | A | 1/2016 |
| JP | 2017220915 | A | 12/2017 |

* cited by examiner

VEHICLE ANTENNA DEVICE

CROSS-REFERENCE TO RELATED APPLICATIONS

This application is a U.S. national stage application of International Application No. PCT/JP2019/008871, filed on Mar. 6, 2019, and claims priority to Japanese Patent Application No. 2018-069321 filed on Mar. 30, 2018.

TECHNICAL FIELD

The present invention relates to a vehicle antenna device, and more particularly to a vehicle antenna device which is suited to achieve a reduction in thickness.

BACKGROUND INFORMATION

A pillar antenna, roof-mounted antenna, and glass antenna are among the antenna devices that are mounted on a vehicle to support a plurality of frequency bands, or, for example, the antenna devices that support AM/FM bands. However, the pillar antenna, which protrudes greatly, is at high risk of being bent by contact or any other trouble. The roof-mounted antenna needs to be folded or removed in such places as a multistory car park and an automatic car-washing machine because of a higher ground clearance. The problem with the glass antenna is that the antenna involves a specific development for each vehicle model, leading to higher development and production costs and the like.

Then, in recent years, great importance has been attached to the design of vehicles, and there is growing demand for the vehicle-mounted antenna devices that do not ruin the appearance of vehicles as much as possible. Therefore, various antennas that could be built inside a spoiler have been developed so that the appearance is not ruined (e.g., Japanese Laid Open Patent Application Publication No. 2014-216661, which is referred to below as Patent Document 1, or Japanese Laid Open Patent Application Publication No. 2016-012915, which is referred to below as Patent Document 2).

SUMMARY

For example, according to the existing techniques, when an antenna device is to be built in a spoiler, its antenna element would be shaped like a plate and connected to a circuit board to configure a flat structure as a whole. However, antenna devices for the use of automobiles may face the issues of vehicle vibrations or shaking. In other words, the weight of the antenna element itself and the vibration of the vehicle can apply a heavy load onto a connection portion between the antenna element and the circuit board. Such a load applied to the connection part can cause contact failure or other trouble in electrical connection between the antenna element and the circuit board. Such contact failure could be avoided presumably by providing a separate connection terminal or using a fixing case, for example. However, the foregoing measures against the contact failure that inevitably increase the number of components and assembly processes lead to increase in production cost. To solve the above problem, there has been a demand for a vehicle antenna device which is suitable to achieve a reduction in thickness with a low-cost structure.

In view of the above situation, the present invention has been made and the object thereof is to provide a vehicle antenna device which is suited to achieve a reduction in thickness with a low-cost structure, while preventing antenna characteristics from being deteriorated.

In order to achieve the above object of the present invention, the vehicle antenna device according to the present invention may include: an antenna element having a flat plate-like portion, the antenna element having an antenna capacitance to function as a capacitive antenna supporting a first frequency band and having a power feeding line provided at an edge portion of the antenna element, the power feeding line being formed from the same member as the antenna element; a circuit board having a power feeding portion to which the power feeding line of the antenna element is connected; a coil which is placed on the circuit board and electrically connected to the power feeding portion to which the power feeding line of the antenna element is connected so that the antenna element has an antenna length supporting a second frequency band; an amplifier circuit which is placed on the circuit board and connected to the coil; and a fixing portion which is formed from the same member as the antenna element and formed at an edge of the antenna element in order to fix the circuit board to the antenna element at a location close to a position of the coil of the circuit board and far from a position of the amplifier circuit, the fixing portion fixing the circuit board to the edge of the antenna element with a predetermined gap from the coil that is large enough to avoid an influence of coupling with the coil.

Herein, the antenna element may have a rectangular shape, the circuit board may have a rectangular shape, the fixing portion may be formed from the same member as the antenna element and formed at a short-side edge of the antenna element, and the antenna element and the circuit board may be connected and fixed together in a longitudinal direction thereof.

The fixing portion may be constituted by bending the flat plate-like portion of the antenna element so as to hold the circuit board.

The fixing portion may further include claw portions which function to immobilize the circuit board for preventing movement of the circuit board toward directions that differ from directions of holding the circuit board.

The fixing portion may be constituted by bending opposite side portions of the flat plate-like portion at right angles and bending top portions of the side portions bent toward an upper surface side of the circuit board, thereby fixing the circuit.

The fixing portion may have a cutout at a center portion thereof so as not to overlie the circuit board.

Further, the present invention may include a clip portion provided adjacent to the fixing portion and configured to fix the vehicle antenna device to a vehicle.

The circuit board on which the coil and the amplifier circuit are arranged may be wrapped in an insulating resin.

The power feeding line of the antenna element may have a spring-like portion which functions to reduce a load to the power feeding portion to which the power feeding line is connected.

Further, the present invention may include a grounding bracket which serves as the ground of the circuit board and is directly grounded to a conductive member arranged on the body of a vehicle.

The grounding bracket may cover a cable connecting portion, where a signal cable is connected to the circuit board.

The vehicle antenna device according to the present invention has the benefit of suitably reducing thickness with a low-cost structure, while preventing antenna characteristics from being deteriorated.

DETAILED DESCRIPTION OF THE EMBODIMENTS

Figure 1A:
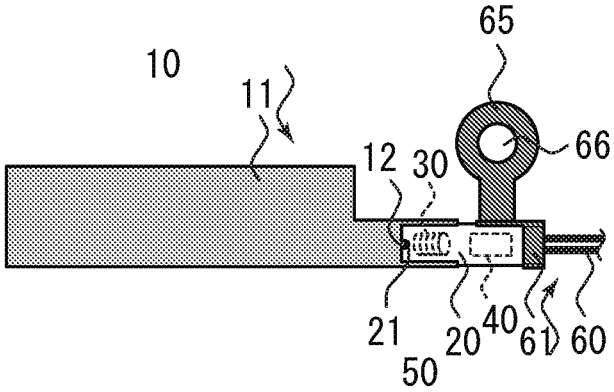
FIGS. 1A and 1B are schematic diagrams for explaining the details of the vehicle antenna device according to the present invention.
Figure 1B:
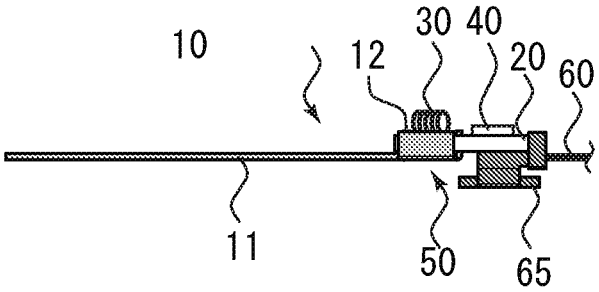

Hereinafter, an embodiment for practicing the present invention will be described with reference to the accompanying drawings. FIGS. 1A and 1B are schematic diagrams for explaining the details of the vehicle antenna device according to the present invention, in which FIG. 1A is a top view and FIG. 1B is a side view. As illustrated, the vehicle antenna device according to the present invention is mainly constituted by an antenna element 10, a circuit board 20, a coil 30, an amplifier circuit 40, and a fixing portion 50. For example, these components may be embedded in the vehicle body, e.g., a vehicle roof, or built in a spoiler.

The antenna element 10 has a flat plate-like portion 11. The flat plate-like portion 11 is the main part of the antenna element 10. The antenna element 10 has an antenna capacitance to function as a capacitive antenna supporting a first frequency band. Herein, the first frequency band refers to, e.g., the AM radio band. The antenna element 10 according to the present invention is intended to function as a capacitive antenna; therefore, the area of the flat plate-like portion 11 should be determined to have an antenna capacitance enough to receive the first frequency band. The antenna element 10 may be formed, for example, through metal plate machining. That is, a metal plate is cut out into, e.g., a rectangular form to constitute the flat plate-like portion. Further, the flat plate-like portion of the antenna element 10 may be a meander element configured to provide an antenna capacitance substantially equivalent to that of the flat plate-like portion so long as it provides an antenna capacitance enabling it to function as a capacitive antenna which supports the first frequency band. A power feeding line 12 is provided at an edge portion of the antenna element 10; the antenna element 10 and the power feeding line 12 are formed from the same member. The power feeding line 12 may be formed as a pin shape processed by, e.g., bending an edge portion of the flat plate-like portion 11. The antenna element 10 and the power feeding line 12 thereof may be integrally formed in this way by subjecting a single conductive plate-like member being the same member to metal plate machining or the like.

The circuit board 20 has a power feeding portion 21 to which the power feeding line 12 of the antenna element 10 is connected. That is, the power feeding line 12 of the antenna element 10 is connected to the power feeding portion 21. The circuit board 20 may be, for example, a common printed circuit board. The coil 30 and an amplifier circuit 40 to be described later are mounted on the circuit board 20. Further, the circuit board 20 is connected with a signal cable 60 which is connected to, e.g., a tuner disposed inside a vehicle. Additionally, when the antenna element 10 is constituted by a printed circuit board, the printed circuit board may be shared with the circuit board 20. In other words, a single printed circuit board may be used as both the antenna element 10 and the circuit board 20.

The coil 30 is placed on the circuit board 20 and electrically connected to the power feeding portion 21 to which the power feeding line 12 of the antenna element 10 is connected so that the antenna element 10 has an antenna length supporting to a second frequency band. The length of the coil 30 is determined so that the antenna element 10 has the antenna length supporting the second frequency band. In other words, the coil 30 is provided for the purpose of compensating the lack of the length of the antenna element 10, so that the antenna element 10 can function as a resonance antenna with respect to the second frequency band. Herein, the second frequency band may be, e.g., the frequency band for FM radio broadcast, DAB (Digital Audio Broadcast) or UHF (Ultra-High Frequency). The coil 30 is series-connected between the antenna element 10 and the amplifier circuit 40. The coil 30 is, for example, a helically wound conducting wire. As illustrated herein, the coil 30 is placed on the circuit board 20 in such a manner that the antenna element 10 lies in its axial direction. Specifically, the coil 30 is arranged in such a way as to be axially parallel to the line connecting between the antenna element 10 and the amplifier circuit 40. The present invention, however, is not limited to the above arrangement; the coil 30 may be arranged so as to be axially perpendicular to the line connecting between the antenna element 10 and the amplifier circuit 40 so long as the length of the coil 30 fits within the width of the circuit board 20. Further, as illustrated, the coil 30 is a so-called air core coil. However, the present invention is not limited to this; the coil may be constituted by a wiring pattern or the like formed on the circuit board 20.

The amplifier circuit 40 is placed on the circuit board 20 and connected to the coil 30. The amplifier circuit is used to amplify a signal received from the antenna element 10.

The fixing portion 50 is provided to fix the circuit board 20 to the antenna element 10. The fixing portion 50 and the antenna element 10 are formed from the same member, and the fixing portion 50 is formed at an edge of the antenna element 10. The antenna element 10 is fixed by way of the fixing portion 50 to the circuit board 20 at a location close to the position of the coil 30 and far from the position of the amplifier circuit 40. The fixing portion 50 is designed to fix the circuit board 20 to the edge of the antenna element 10, providing a predetermined gap from the coil 30 that is large enough to avoid the influence of coupling with the coil 30.

Figure 2A:
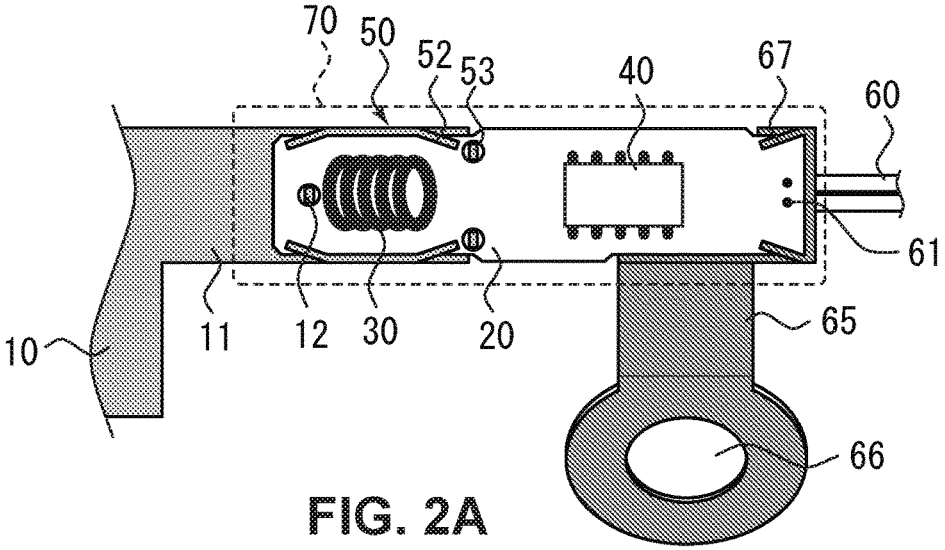
FIGS. 2A, 2B and 2C are enlarged schematic diagrams for explaining a fixing portion of the vehicle antenna device according to the invention.
Figure 2B:
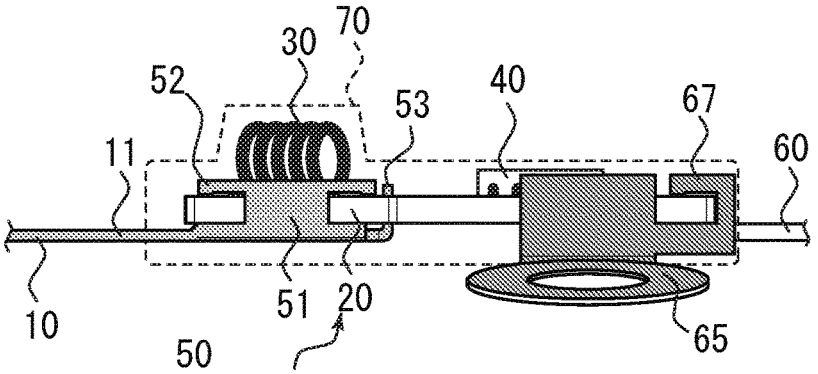
Figure 2C:
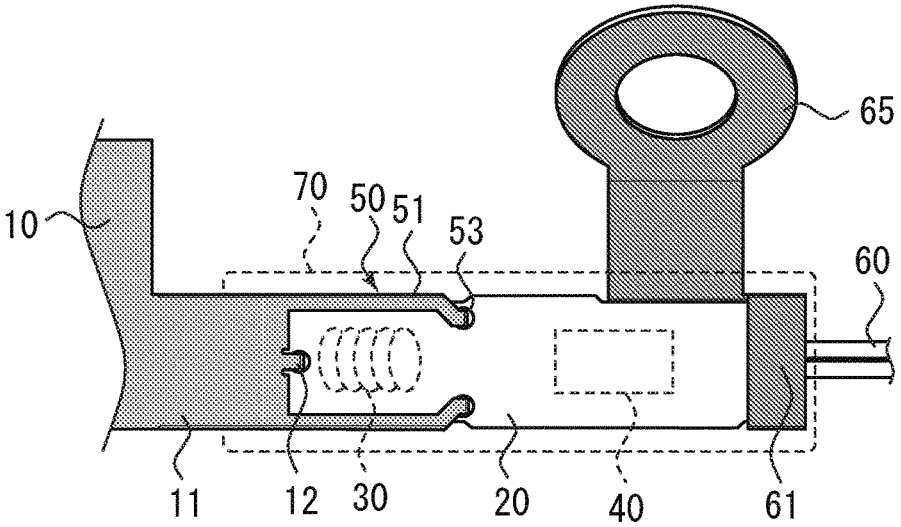

The fixing portion of the vehicle antenna device according to the present invention will more specifically be described using FIGS. 2A, 2B and 2C. FIGS. 2A, 2B and 2C are enlarged schematic diagrams for explaining the fixing portion of the vehicle antenna device according to the invention, in which FIG. 2A is a top view, FIG. 2B is a side view, and FIG. 2C is a rear view. In the drawings, the same reference numerals as those in FIGS. 1A and 1B denote the same parts as those in FIGS. 1A and 1B. As illustrated, the fixing portion 50 is constituted by bending the flat plate-like portion 11 of the antenna element 10 in such a way as to hold opposite side portions of the circuit board 20. More specifically, the fixing portion 50 is constituted by bending opposite side portions of the flat plate-like portion 11 at right angles and holding the circuit board 20. Then, top portions 52 of side portions 51 thus bent are bent toward the upper surface side of the circuit board 20 in order to fix the circuit board 20. That is, the opposite side portions and the upper and lower surfaces of the circuit board 20 are held by the side portions 51 and the top portions 52. Additionally, the fixing portion 50 includes claw portions 53 which function to immobilize the circuit board 20 for preventing the movement of the circuit board 20 toward directions that differ from the directions of holding the circuit board 20. As illustrated in FIG. 2C, where the rear side of the circuit board 20 is shown, the claw portions 53 are constituted by separated tip ends of the fixing portion 50 extending toward the direction where the amplifier circuit 40 lies and the tip ends are bent toward the circuit board 20 side to pierce therethrough. Note that the claw portions 53 are also formed from the same member as the antenna element 10; therefore, the claw portions 53 also are electrically connected to the power feeding line 12. Thus, it is best to fix the claw portions 53 to the circuit board 20 in an electrically floating condition so as to avoid electrical connection to the ground or the like.

As illustrated in the figures, the fixing portion 50 is configured with the least possible amount of protrusion on the surface of the circuit board 20 on which the coil 30 is placed in order to avoid the influence of coupling with the coil 30. The top portions 52 of the fixing portion 50 are bent toward the upper surface side of the circuit board 20 while being kept away from side portions of the coil 30, so that the bent top portions 52 are not connected to the coil 30. Further, it is designed so that the fixing portion 50 does not exist on the rear surface side of the circuit board 20 at the location corresponding to the position of the coil 30. That is, the claw portions 53 are arranged along the opposite side portions of the circuit board 20. This configuration makes it possible to keep the coil 30 as far away from a conductor that can be the cause of reduction of Q-factor of the coil 30 as possible. Such an arrangement prevents the performance degradation of the coil 30 and the reduction of antenna gain.

The vehicle antenna device according to the present invention comprises the antenna element 10 and the circuit board 20 both of which have a rectangular and a flat plate-like body, and therefore fits for thinning thereof. Then, as illustrated in the drawings, the fixing portion 50 may be formed from the same member and formed at a short-side edge of the antenna element 10, and the antenna element 10 and the circuit board 20 are therefore connected and fixed to each other in the longitudinal direction. As a result, the vehicle antenna device of the present invention achieves a thin rectangular profile, which can readily be installed inside a spoiler or a roof of a vehicle.

When such a vehicle antenna device according to the present invention is to be embedded in the body of a vehicle, such as a vehicle roof, the antenna device is directly grounded to a conductive member arranged in the body of the vehicle. More specifically, a grounding bracket 65 serving as the ground of the circuit board 20 may be provided, for example. The grounding bracket 65 is directly grounded to a conductive member arranged on the body of a vehicle. In other words, the grounding bracket 65 is a part of the ground of the antenna element 10, which is a grounded-type antenna. For example, when the antenna element 10 is designed to be arranged parallel to the top roof of a vehicle, the grounding bracket 65 may directly be grounded to a conductive member arranged on the body of a vehicle at an angle different from the angle of the roof surface. More specifically, the grounding bracket 65 may be directly grounded to a pillar of the vehicle that is to be disposed substantially perpendicularly to the roof of the vehicle. Then, if the pillar is a conductive member, an electric current can be made to flow to the direction of ground (vertical direction) via the pillar. Therefore, even with the antenna element 10 which is embedded parallel to the roof of the vehicle (horizontal direction) and hence the main polarization of which is horizontal polarization, the sensitivity of vertical polarization, which is a polarized wave substantially perpendicular to the roof surface of the vehicle, can be improved.

The grounding bracket 65 may be constituted to hold the longitudinally opposite side portions of the circuit board 20. Specifically, the grounding bracket 65 is formed by bending a conductive plate-like member by way of, e.g., metal plate machining, and has a prescribed screw hole 66 so as to be directly grounded to the body of a vehicle. The grounding bracket 65 and the body of the vehicle are tightened together with, e.g., a bolt through the screw hole 66. A sidewall top portion 67 of the grounding bracket 65 is bent toward the upper surface side of the circuit board 20 so as to be fixed thereto. Then, the grounding bracket 65 is electrically connected to the ground of the circuit board 20 and serves as the ground of the circuit board 20. Incidentally, the grounding bracket 65 may be grounded to the body of the vehicle using an additionally provided metal joint or the like.

Also, the vehicle antenna device according to the present invention may be wrapped in mold resin, a resin cover, or the like. Referring back to FIGS. 2A, 2B and 2C, the circuit board 20 on which the coil 30 and the amplifier circuit 40 are arranged may be wrapped in an insulating resin 70, as indicated by a broken line. That is, the surrounding regions of the circuit board 20 of the vehicle antenna device may be resin-molded using the insulating resin 70. The insulating resin 70 may be a cover configured by a resin casing. If the resin casing is made of a hard material, even when a stress is applied to the fixing portion 50 fixing the antenna element 10 and the circuit board 20 together, more reliable protection of the circuit board 20 is possible. Additionally, it is possible to obtain waterproof in the case of using packing or performing bonding to hold the circuit board 20 in the resin casing or in the case of resin-molding the circuit board 20.

When surrounding regions of the circuit board 20 are to be resin-molded, it is preferable to keep the fixing portion 50 from covering over the circuit elements placed on the circuit board 20. As viewed from the rear side of the circuit board 20 in FIG. 2C, the fixing portion 50 has a cutout at a center portion thereof so as not to overlie the circuit board 20. That is, the claw portions 53 are made to pierce the circuit board 20 in such a way that they extend from two sides of the power feeding line 12 toward the direction of the amplifier circuit 40, while running along the both sides of the coil 30 to avoid the coil 30. In this way, even if the surrounding regions of the circuit board 20 are resin-molded using the insulating resin 70, it is possible to prevent the circuit elements from coming off when the insulating resin 70 is thermally expanded or due to any other causes. In other words, regarding the fixing portion 50 formed at an edge of the flat plate-like portion 11, the cutout created at the center portion thereof so as not to overlie the circuit board 20 avoids the fixing portion 50 from connecting to the coil 30 as well as preventing the insulating resin 70 from causing adverse effects on the circuit elements.

Further, when the grounding bracket 65 is provided in the vehicle antenna device according to the present invention, it is preferable to keep the grounding bracket 65 from being put over the circuit elements placed on the circuit board 20, when the surrounding regions of the circuit board 20 are subjected to resin molding. As illustrated in FIG. 2C, the grounding bracket 65 is not put over the circuit elements of the circuit board 20. Nonetheless, a cable connecting portion 61 where the signal cable 60 is connected to the circuit board 20 may be covered by the grounding bracket 65. This arrangement makes it possible to prevent the circuit elements from coming off when the insulating resin 70 is thermally expanded or due to any other causes, even when the surrounding regions of the circuit board 20 are resin-molded using the insulating resin 70. In addition, a shielding effect of the cable connecting portion 61 can also be expected.

Figure 3:
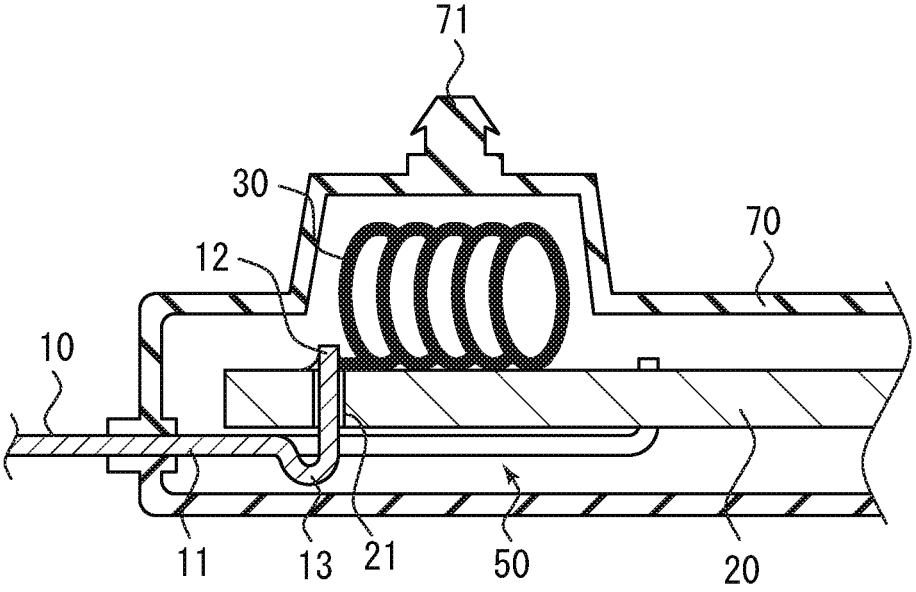
FIG. 3 is an enlarged schematic side view for explaining a neighborhood of the fixing portion of the vehicle antenna device according to the invention.

Now, components surrounding the fixing portion of the vehicle antenna device according to the present invention will more specifically be described with reference to FIG. 3. FIG. 3 is an enlarged schematic side view for explaining a neighborhood of the fixing portion of the vehicle antenna device according to the present invention. In the drawing, the same reference numerals as those in FIGS. 1A, 1B, 2A, 2B and 2C denote the same parts as those in FIGS. 1A, 1B, 2A, 2B and 2C. The insulating resin 70 shown in FIG. 3 is a cover constituted by resin casing. As illustrated, the vehicle antenna device according to the present invention may include a clip portion 71. The clip portion 71 is provided adjacent to the fixing portion 50, and used to fix the vehicle antenna device to a vehicle. Herein, the phrase "fixing to a vehicle" includes fixing the vehicle antenna device to a vehicle roof or a spoiler. It is preferable that the clip portion 71 be located adjacent to the power feeding portion 21 in order to minimize a load that could be applied, due to, e.g., vibrations, to the electrically connecting position between the power feeding line 12 of the antenna element 10 and the power feeding portion 21 of the circuit board 20. As illustrated, the clip portion 71 may be formed integrally with the insulating resin 70.

Further, as illustrated in the drawing, the power feeding line 12 of the antenna element 10 may have a spring-like portion 13. The spring-like portion 13 functions to reduce the load to the power feeding portion 21 to which the power feeding line 12 is connected. In the illustrated example, the power feeding line 12 is made deflectable; therefore, even if the flat plate-like portion 11 of the antenna element 10 vibrates, the deflectable spring-like portion 13 can absorb the vibration. This configuration prevents the electrically connecting position between the power feeding line 12 and the power feeding portion 21 from suffering a direct load.

As described above, the vehicle antenna device according to the present invention adopts an antenna element which has a flat plate-like body simply cut out from a metal plate and has a certain degree of weight. This antenna element, however, is firmly fixed to the circuit board by the fixing portion and, therefore, would by no means cause contact failure. Further, since the fixing portion has no adverse effect on the coil, degradation in antenna characteristics is also avoidable. Furthermore, also in the case of subjecting the circuit board to resin molding, the circuit elements placed on the circuit board would by no means badly affected.

The vehicle antenna device according to the present invention is not limited to the above illustrative examples but may be variously modified without departing from the scope of the present invention.

The invention claimed is:

1. A vehicle antenna device, the vehicle antenna device comprising:

an antenna element having a flat plate-like portion, the antenna element having an antenna capacitance to function as a capacitive antenna supporting a first frequency band and having a power feeding line provided at an edge portion of the antenna element, the power feeding line being formed from the same member as the antenna element;

a circuit board having a power feeding portion to which the power feeding line of the antenna element is connected;

a coil which is placed on the circuit board and electrically connected to the power feeding portion to which the power feeding line of the antenna element is connected so that the antenna element has an antenna length supporting a second frequency band;

an amplifier circuit which is placed on the circuit board and connected to the coil; and a fixing portion which is formed from the same member as the antenna element and formed at an edge of the antenna element in order to fix the circuit board to the antenna element at a location close to a position of the coil of the circuit board and far from a position of the amplifier circuit, the fixing portion fixing the circuit board to the edge of the antenna element with a predetermined gap from the coil that is large enough to avoid an influence of coupling with the coil.

2. The vehicle antenna device according to claim 1, wherein the antenna element has a rectangular shape;

the circuit board has a rectangular shape;

the fixing portion is formed from the same member as the antenna element and formed at short-side edge of the antenna element; and the antenna element and the circuit board are connected and fixed together in a longitudinal direction thereof.

3. The vehicle antenna device according to claim 1, wherein the fixing portion is constituted by bending the flat plate-like portion of the antenna element so as to hold the circuit board.

4. The vehicle antenna device according to claim 3, wherein the fixing portion further includes claw portions which function to immobilize the circuit board for preventing movement of the circuit board toward directions that differ from directions of holding the circuit board.

5. The vehicle antenna device according to claim 2, wherein the fixing portion is constituted by bending opposite side portions of the flat plate-like portion at right angles and bending top portions of the side portions bent toward an upper surface side of the circuit board, thereby fixing the circuit board.

6. The vehicle antenna device according to claim 3, wherein the fixing portion has a cutout at a center portion thereof so as not to overlie the circuit board.

7. The vehicle antenna device according to claim 1, further comprises a clip portion provided adjacent to the fixing portion and configured to fix the vehicle antenna device to a vehicle.

8. The vehicle antenna device according to claim 1, wherein the circuit board on which the coil and the amplifier circuit are arranged is wrapped in an insulating resin.

9. The vehicle antenna device according to claim 1, wherein the power feeding line of the antenna element has a spring-like portion which functions to reduce a load to the power feeding portion to which the power feeding line is connected.

10. The vehicle antenna device according to claim 1, further comprises a grounding bracket which serves as a ground of the circuit board and is directly grounded to a conductive member arranged on a body of a vehicle.

11. The vehicle antenna device according to claim 10, wherein the grounding bracket covers a cable connecting portion, where a signal cable is connected to the circuit board.

* * * * *